US008231403B2

(12) United States Patent
Smith

(10) Patent No.: US 8,231,403 B2
(45) Date of Patent: Jul. 31, 2012

(54) QUICK MOUNTING DEVICE

(76) Inventor: Benjamin J. Smith, Las Vegas, NV (US)

( * ) Notice: Subject to any disclaimer, the term of this patent is extended or adjusted under 35 U.S.C. 154(b) by 154 days.

(21) Appl. No.: 12/872,086

(22) Filed: Aug. 31, 2010

(65) Prior Publication Data

US 2012/0052722 A1 Mar. 1, 2012

(51) Int. Cl.
*H01R 13/66* (2006.01)

(52) U.S. Cl. ..... 439/529

(58) Field of Classification Search ..... 439/537, 439/140, 313, 337, 673; 362/147, 404–406
See application file for complete search history.

(56) References Cited

U.S. PATENT DOCUMENTS

| | | | |
|---|---|---|---|
| 3,693,921 | A | 9/1972 | Beaucher |
| 3,798,584 | A | 3/1974 | Person |
| 3,996,415 | A | 12/1976 | Provorse |
| 4,295,180 | A | 10/1981 | Herron et al. |
| 4,296,280 | A | 10/1981 | Richie |
| 4,403,278 | A | 9/1983 | Flood |
| 4,449,168 | A | 5/1984 | Ewing |
| 4,645,286 | A | 2/1987 | Isban et al. |
| 4,645,289 | A | 2/1987 | Isban |
| 4,843,782 | A | 7/1989 | Gustaveson et al. |
| 4,887,073 | A | 12/1989 | Nakao et al. |
| 5,064,161 | A | 11/1991 | Anderson |
| 5,542,859 | A | 8/1996 | Ison et al. |
| 5,562,341 | A | 10/1996 | Strauss |
| 5,619,217 | A | 4/1997 | Mailandt et al. |
| 5,622,395 | A | 4/1997 | Shine et al. |
| 5,924,665 | A | 7/1999 | Sweere et al. |
| 5,931,432 | A | 8/1999 | Herold et al. |
| 6,042,068 | A | 3/2000 | Tcherny |
| 6,070,383 | A | 6/2000 | Jeanseau |
| 6,093,044 | A | 7/2000 | Arbuckle |
| 6,131,863 | A | 10/2000 | Fiacco |
| 6,164,475 | A | 12/2000 | Jorgensen |
| 6,210,208 | B1 | 4/2001 | Barnes et al. |
| 6,266,250 | B1 | 7/2001 | Foye |
| 6,322,232 | B1 | 11/2001 | Oliver |
| 6,376,770 | B1 | 4/2002 | Hyde |
| 6,379,012 | B1 | 4/2002 | Enochs et al. |
| 6,482,018 | B1 | 11/2002 | Stekelenburg |
| 6,503,099 | B2 | 1/2003 | Kerr, Jr. |
| 6,634,901 | B2 | 10/2003 | Kerr, Jr. |
| 6,648,488 | B1 | 11/2003 | Pearce |
| 6,669,029 | B1 | 12/2003 | Beane |
| 6,676,442 | B2 | 1/2004 | Kerr, Jr. |
| 6,679,647 | B2 | 1/2004 | Hixon |
| 6,752,366 | B2 | 6/2004 | Chuang |
| 6,780,049 | B1 | 8/2004 | D'Angelo et al. |
| 6,799,982 | B2 | 10/2004 | Kerr, Jr. |
| 6,857,903 | B2 | 2/2005 | Hyde |
| 6,863,499 | B2 | 3/2005 | Pearce |
| 6,872,054 | B2 | 3/2005 | Pearce |
| 6,932,578 | B2 * | 8/2005 | Pearce ..... 416/244 R |
| 6,945,815 | B1 | 9/2005 | Mullally |
| 6,956,170 | B1 | 10/2005 | Gretz et al. |
| 6,997,740 | B2 | 2/2006 | Kerr |
| 7,094,113 | B1 | 8/2006 | Hasenour et al. |
| 7,095,608 | B2 | 8/2006 | Simmons et al. |
| 7,156,359 | B2 | 1/2007 | Dittmer et al. |

(Continued)

*Primary Examiner* — Tulsidas C Patel
*Assistant Examiner* — Phuongchi Nguyen
(74) *Attorney, Agent, or Firm* — Triangle Patents, P.L.L.C.

(57) ABSTRACT

A quick mounting device for appliances that is quickly and easily engaged and disengaged mechanically and electrically without the use of tools and furthermore has two mechanical engagement mechanisms.

1 Claim, 7 Drawing Sheets

U.S. PATENT DOCUMENTS

| | | | | |
|---|---|---|---|---|
| 7,160,148 | B2 | 1/2007 | Kerr | |
| 7,175,152 | B2 | 2/2007 | Dittmer | |
| 7,201,354 | B1 | 4/2007 | Lee | |
| 7,207,543 | B2 | 4/2007 | Ortwein | |
| 7,242,576 | B2 | 7/2007 | Coster et al. | |
| 7,249,744 | B2 | 7/2007 | Bacon et al. | |
| 7,279,635 | B2 | 10/2007 | Hyde | |
| 7,315,417 | B2 | 1/2008 | Chen et al. | |
| 7,540,460 | B2 | 6/2009 | Orth et al. | |
| 7,540,790 | B2 | 6/2009 | Weber et al. | |
| 7,614,922 | B1 | 11/2009 | Buse | |
| 7,663,868 | B1 | 2/2010 | Lam | |
| 7,726,617 | B2 | 6/2010 | Zambelli et al. | |
| 2002/0111063 | A1 | 8/2002 | Kerr | |
| 2003/0026445 | A1 | 2/2003 | Anderson | |
| 2003/0060067 | A1 | 3/2003 | Kerr, Jr. | |
| 2003/0136605 | A1 | 7/2003 | Chuang | |
| 2003/0138291 | A1 | 7/2003 | Hixon | |
| 2003/0148649 | A1 | 8/2003 | Kerr | |
| 2003/0148659 | A1* | 8/2003 | Walker et al. | 439/537 |
| 2004/0016561 | A1 | 1/2004 | Barnes | |
| 2004/0211872 | A1 | 10/2004 | Dittmer et al. | |
| 2005/0067180 | A1 | 3/2005 | Dinh | |
| 2005/0077446 | A1 | 4/2005 | Bacon et al. | |
| 2005/0085131 | A1 | 4/2005 | Sutherland | |
| 2005/0126813 | A1 | 6/2005 | Hyde | |
| 2005/0127260 | A1 | 6/2005 | Dittmer | |
| 2005/0272306 | A1* | 12/2005 | Kerr, Jr. | 439/537 |
| 2005/0279898 | A1 | 12/2005 | Sweere et al. | |
| 2009/0280673 | A1* | 11/2009 | Kohen | 439/366 |
| 2010/0108837 | A1 | 5/2010 | Felton | |
| 2011/0174943 | A1* | 7/2011 | Smith | 248/220.21 |
| 2011/0306234 | A1* | 12/2011 | Smith | 439/537 |

* cited by examiner

Figure 6A
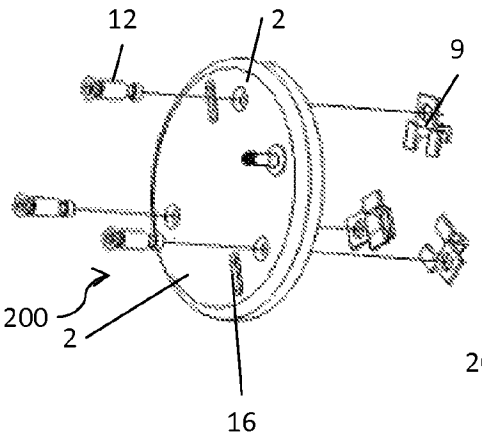
Figure 6B
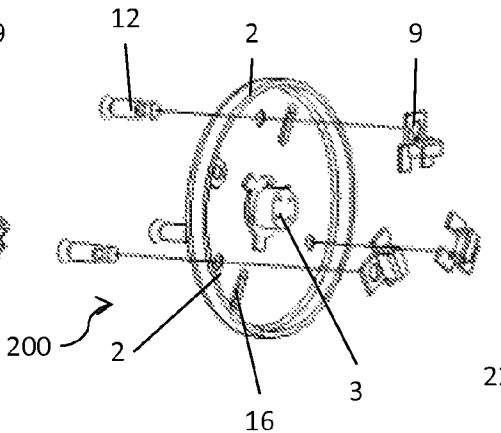
Figure 6C
Figure 6D
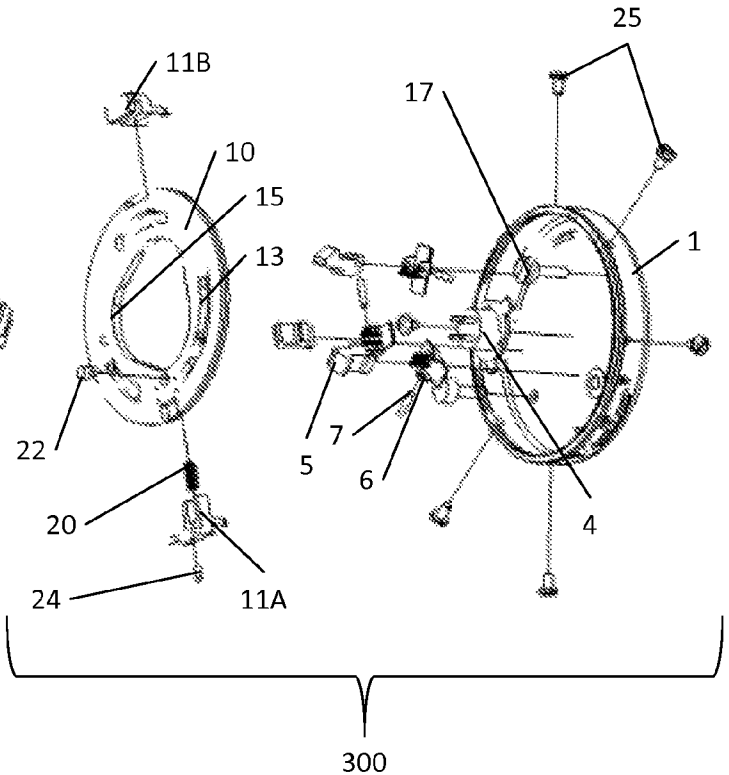

QUICK MOUNTING DEVICE

CROSS-REFERENCE TO RELATED APPLICATIONS

This non-provisional utility patent application claims the benefit of prior filed U.S. provisional application Ser. No. 61/269,962 filed Jan. 19, 2010, which is incorporated herein by reference in its entirety.

BACKGROUND OF THE INVENTION

1. Field of the Invention

The present invention relates to mounting devices in general and particularly to appliance mounting devices allowing quick connection and mounting of electrical appliances at electrical outlets.

2. Description of the Prior Art

There are numerous mechanical, electronic and electromechanical devices that require mounting on a surface such as a ceiling, wall or other surface. Typically the devices require a strong mechanical attachment to the ceiling, wall or other surface while at the same time requiring an electrical connection to power typically supplied by wiring in the ceiling, wall or other surface. Such devices include but are not limited to: ceiling fans, chandeliers and other lighting fixtures, hanging retractable power shop tools/devices, televisions (tubes, flat screens, plasma, etc.), projectors, speakers, cameras, fire/smoke/heat/gas detectors, garage door openers, microwave ovens and numerous other hanging fixtures.

U.S. Pat. No. 6,093,044 issued Jul. 25, 2000 and assigned to Pelco for a quick connect/disconnect mechanism describes a latch and catch quick connect/disconnect mechanism for mechanically mounting an electric or electronic device within a receptacle box or housing.

U.S. Pat. No. 6,042,068 issued Mar. 28, 2000 and assigned to Peerless Industries Inc for a low profile LCD projector mount describes a low profile projector mount having an upper element attached to the ceiling with slide guides projecting from its bottom surface and a lower element attached to the projector with flanges in slideable engagement with the guides. The upper element further has a spring-based latching mechanism.

U.S. Pat. No. 6,857,903 issued Feb. 22, 2005; U.S. Pat. No. 6,376,770 issued Apr. 23, 2002; US Pub. No. 2005/0126813 published Jun. 16, 2005 & US Pub. No. 2003/0124905 published Jul. 3, 2003 assigned to Eclectic Limited for a quick connecting universal electrical box and wiring system describes a quick connecting universal electrical box mounting system for the installation of electrical sockets, switches or any electronic component that is typically installed into a wall for users to access.

U.S. Pat. No. 4,403,278 issued Sep. 6, 1983 and assigned to Harvstone Manufacturing Corporation for a mounting system for suspended lighting fixtures describes a quick mounting system for suspended light fixtures, including a box which is open at one side and a plate dimensioned to cover the opening, a disengageable pivot positioned at one end of the box and plate, and a hooking means at the opposite end of the box and plate.

U.S. Pat. No. 7,201,354 issued Apr. 10, 2007 and assigned to KTV, USA Inc. for a video monitor mounting system describes a video monitor mounting system for use in conjunction with seat back, head restraint or roof mount applications. It includes a mounting tray fixed in a hollowed out socket formed in a seat back, the rear face of a head restraint or within a roof mount overhead console.

U.S. Pat. No. 3,693,921 issued September 1972 and assigned to the United States of America as represented by the Navy for a quick release mounting apparatus describes an apparatus for stable mounting of a device, such as a TV camera, to an underwater support, and which can be easily and quickly locked or unlocked from the support by manipulation of a lever.

U.S. Pat. No. 6,634,901 issued Oct. 21, 2003; U.S. Pat. No. 6,503,099 issued Jan. 7, 2003; & U.S. Pat. No. 6,799,982 issued Oct. 5, 2004 assigned to Angelo Fan Brace Licensing LLC for a quick connect device for electrical fixture describes a quick-connect device for hanging fans, lighting fixtures, and the like. A horizontal sliding connector is provided between the ceiling box and the electrical fixture to take the weight of the fixture as it is inserted.

U.S. Pat. No. 6,676,442 issued Jan. 13, 2004 and assigned to Angelo Fan Brace Licensing LLC for a quick connect device with easy installation features including plug and spring describes a quick-connect device for hanging fans, lighting fixtures, and the like.

U.S. Pat. No. 7,160,148 issued Jan. 9, 2007; U.S. Pat. No. 6,997,740 issued Feb. 14, 2006; US Pub No. 2002/0111063 published Aug. 15, 2002 & US Pub No. 2005/0272306 published Dec. 8, 2005 and assigned to Angelo Fan Brace Licensing LLC for a ceiling fixture with easy installation features describes a quick connect device for electrically and physically mounting the fan to a ceiling.

U.S. Pat. No. 3,798,584 issued March 1974 for a quick connect ceiling electrical fixture mounting describes a quick connect mounting for connecting an electrical fixture to a conventional outlet box positioned within a ceiling. An electrical fixture may be readily plugged into the ceiling and removed therefrom in the same manner as a conventional electrical plug is inserted into and withdrawn from a wall outlet.

U.S. Pat. No. 7,175,152 issued Feb. 13, 2007 and assigned to CSAV Inc. for a display mounting device describes a flat panel display mounting apparatus that enables quick and easy mounting and dismounting of the flat panel display.

U.S. Pat. No. 4,645,286 issued Feb. 24, 1987 and assigned to Elliot Isban for a quick connect power tap system describes a coupling system which allows for quickly changing electrical fixtures without rewiring.

U.S. Pat. No. 4,645,289 issued Feb. 24, 1987 to inventor Elliot Isban for a quick connect power tap system describes an improvement to U.S. Pat. No. 4,645,286 (described above).

US Pub. No. 20090280673 published Nov. 12, 2009 for a quick connect assembly; US Pub. No. 20070167072 published Jul. 19, 2007 for a quick connect device for electrical fixtures and US Pub. No. 20050148241 published Jul. 7, 2005 for a quick connect device for electrical fixtures describe a device for quick connecting and supporting fixtures, such as electrical fixtures.

SUMMARY OF THE INVENTION

The present invention relates to a system for quickly mounting appliances to support structures.

These and other aspects of the present invention will become apparent to those skilled in the art after a reading of the following description of the preferred embodiment when considered with the drawings, as they support the claimed invention.

BRIEF DESCRIPTION OF THE DRAWINGS

FIG. 6A is an exploded, perspective top view of one embodiment of the top assembly of the invention.

FIG. 6B is an exploded, perspective bottom view of one embodiment of the top assembly of the invention.

FIG. 6C is an exploded, perspective top view of one embodiment of the cam plate of the invention.

FIG. 6D is an exploded, perspective top view of one embodiment of the bottom assembly of the invention.

DETAILED DESCRIPTION

The problems associated with the current methods of attaching such devices are numerous and include issues of safety, time and convenience. Current methods and devices for attachment require the simultaneous or near simultaneous connection of electrical connections and mechanical support attachments all while typically balancing on a ladder and using dangerous powered or unpowered tools. Current methods and devices are time-consuming; requiring different mechanical and electrical connections with each device—the majority of which are not user friendly. Many consumers must resort to the expense of a professional installer or handyman to make the required electrical and mechanical connections.

Disclosed herein is a quick mounting system that mounts electric, electronic, mechanical and electro-mechanical devices to a ceiling, wall or other surfaces that addresses the above needs and deficiencies of current methods and devices. This mounting system can be used virtually anywhere a device or an object needs to be installed off the ground without the use of tools. The manually operated locking mechanism enables one to quickly and permanently lock the device/object in place by human hand as well as unlock it without the use of any tools. The quick mounting system may be used to attach/mount electrical, electronic, and mechanical devices with or without power as well as other objects that need to be mounted on walls, ceilings or other surfaces.

Figure 1:
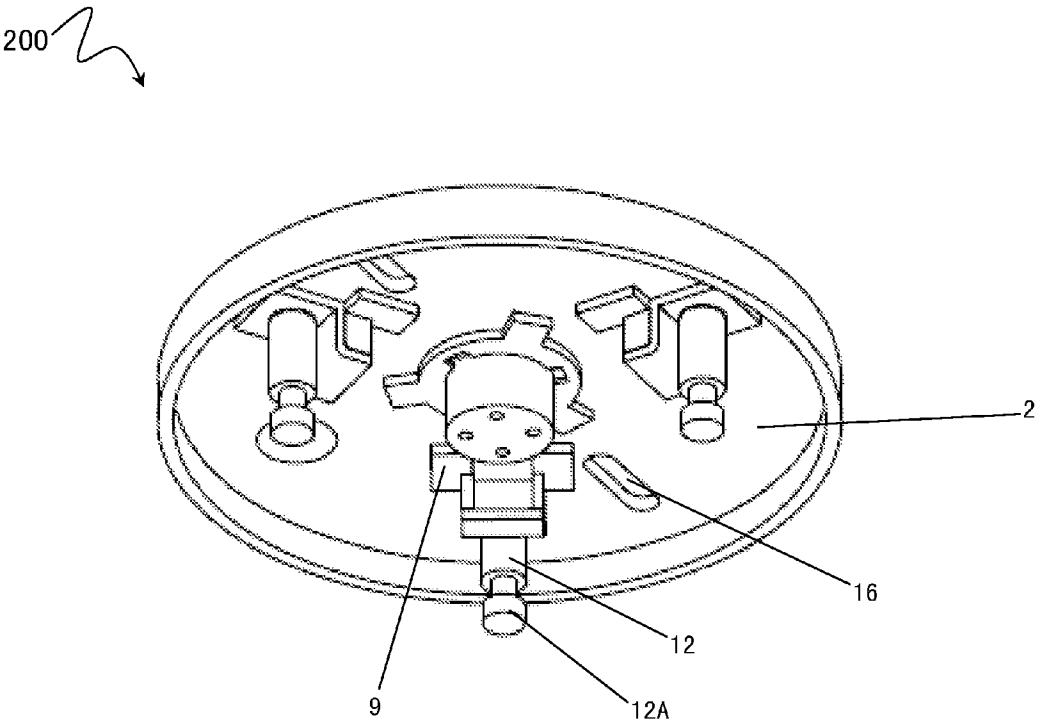
FIG. 1 is a bottom perspective view of one embodiment of the top assembly of the invention.

Referring now to the drawings in general, the illustrations are for the purpose of describing a preferred embodiment of the invention and are not intended to limit the invention thereto. With reference to the figures, only FIG. 1 shows the electrical connectors in place on the quick mount system. The engineering drawings and photographs do not show the electrical connector. However, the electrical connector would generally be located through the center of the top and bottom assemblys of the quick mount system. The dimensions, specifications, materials and other call outs on the engineering drawings are representative only and not critical to the quick mount system. Other dimensions, specifications, materials and call outs are within the scope of the invention disclosed herein.

Figure 2:
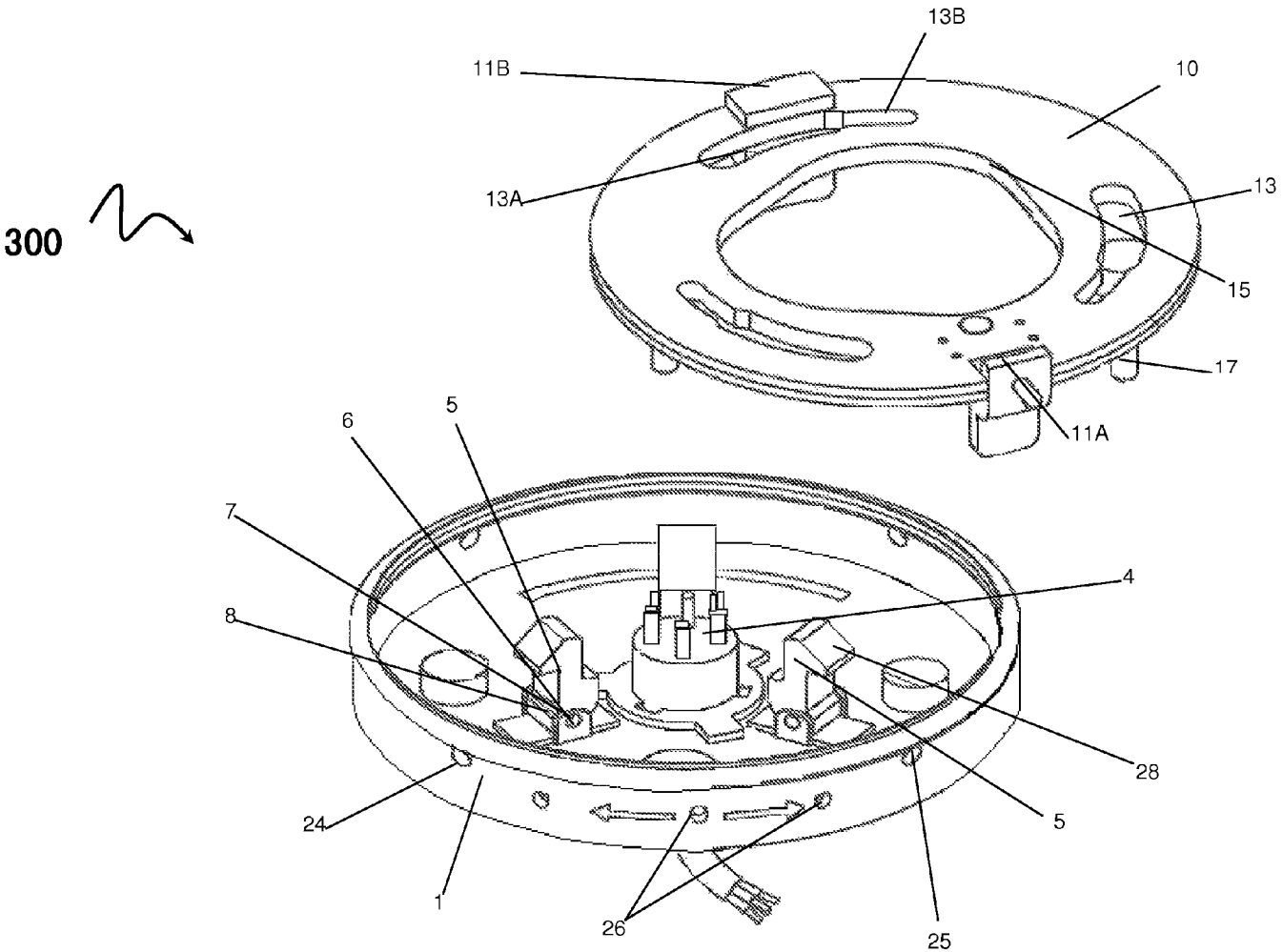
FIG. 2 is a top view of one embodiment of the bottom assembly of the invention.
Figure 3:
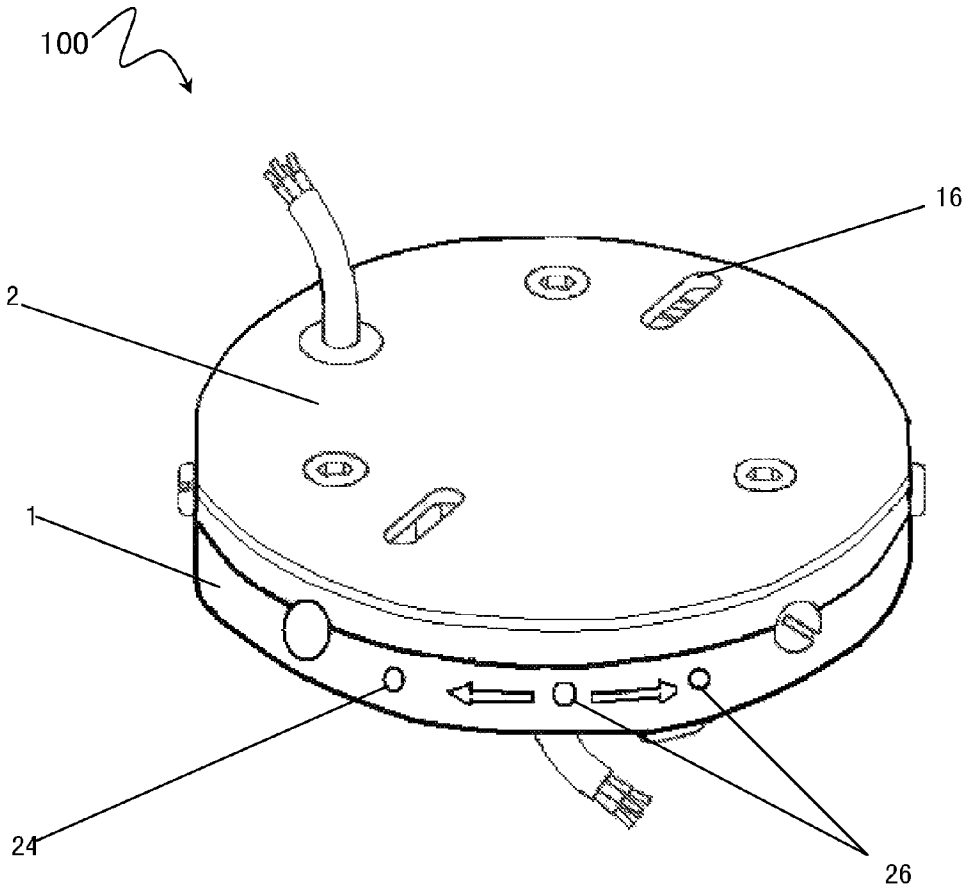
FIG. 3 is a top perspective view of an embodiment of the invention.
Figure 4:
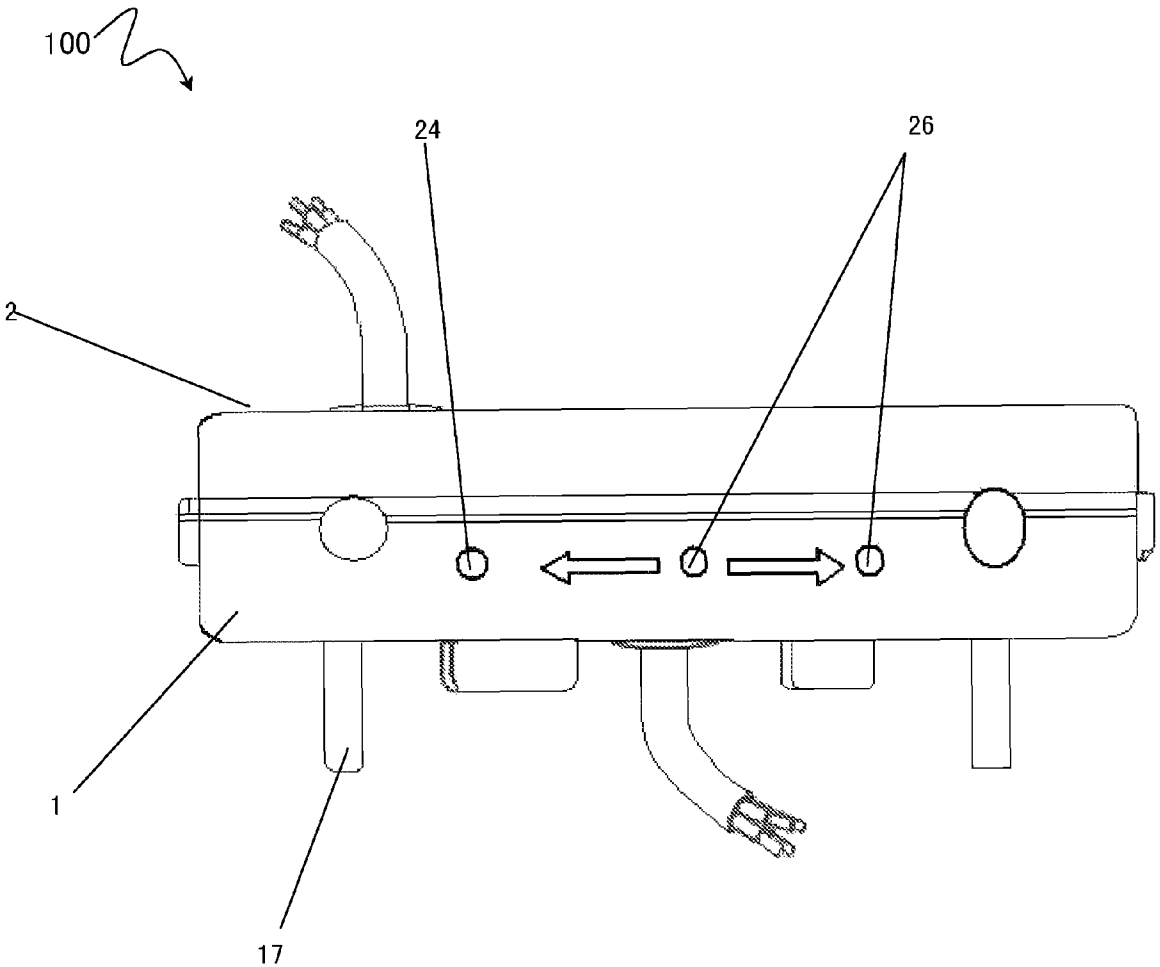
FIG. 4 is a bottom perspective view of an embodiment of the invention.

With reference to FIGS. 1 and 2, in one embodiment described herein, the quick mount system, generally described as 100, includes a top assembly, generally described as 200, and a bottom assembly, generally described as 300. The main weight-bearing components of the device may be manufactured from mild steel. However, the device may be manufactured of any material that has the requisite strength and impact properties that may vary according to the type of apparatus the mounting device is designed to mount. With continuing reference to FIG. 1, included in the top assembly 200 is a female electrical connector 3. The bottom assembly 300 includes a male electrical connector 4 designed to mate with the female electrical connector. In some embodiments, the connectors could be reversed, that is to say, the female connector may be housed in the bottom assembly and the male connector housed in the top assembly. In either case, the male and female connectors are preferably located substantially through the center of the bottom and top assemblies but in any event in such manner so that when the assemblies are brought together as intended by the invention the male and female electrical connectors mate so as to form an electrical connection. The electrical connectors are preferably low profile, rear-mounting connectors but may be of other designs as well.

FIGS. 1, 3, 6A and 6B show the top assembly in detail including the top plate 2 and the three support pins 12 attached to the top plate 2. The top plate 2 would be attached to the wall, ceiling or other surface via the mounting slots 16. The optional electrical connector 3 (shown in FIGS. 1, 6A and 6B; not shown in FIGS. 2 through 5) in the top assembly 200 is connected to the power or other electrical supply in the wall, ceiling or other surface.

FIGS. 2, 4, 6C and 6D show the bottom assembly 300 and its components. The bottom assembly 300 includes a bottom plate 1 which is attached to the device to be mounted (e.g., ceiling fan, flat screen TV, etc.) via the special bolts 17 and the electrical connector 4 in the bottom assembly 300 is connected to the power requirements of the device to be mounted. Once the top assembly 200 is attached to the ceiling, wall or other surface and the bottom assembly 300 is attached to the device to be mounted on the ceiling, wall or other surface, the top assembly 200 and the bottom assembly 300 are merely brought together and a mechanical and electrical connection is securely made as described below.

With reference to FIGS. 2 and 6A-D, three hooks 5 are attached via hook mounts 6, rivets 7 and hook springs 8 to the interior of the bottom plate 1. The hooks 5 are allowed to pivot around the rivets 7 and the hook springs 8 push the hooks toward the periphery of the assembly. The hook mounts 6 are permanently fastened to the bottom plate via screws or rivets. With additional reference to FIG. 1, the hooks 5 include a beveled edge 28 and the hooks are located on the bottom plate 1 so that when the bottom assembly 300 is brought up to and connected with the top assembly 200, the beveled edge 28 causes the hooks to retract toward the center of the assembly and slide around the hook slots 9 attached to the top assembly 200. Once past the hook slots, the hooks 5 extend toward the periphery and latch into hook slots 9. The hooks 5 are spring loaded in such manner that when the cam plate 10 is properly oriented, via the cam positioning tabs 11A and 11B, in the neutral or middle position as described below, the hooks pass freely past the hook slots in the top assembly 200 and catch securely in the hook slots.

Figure 7:
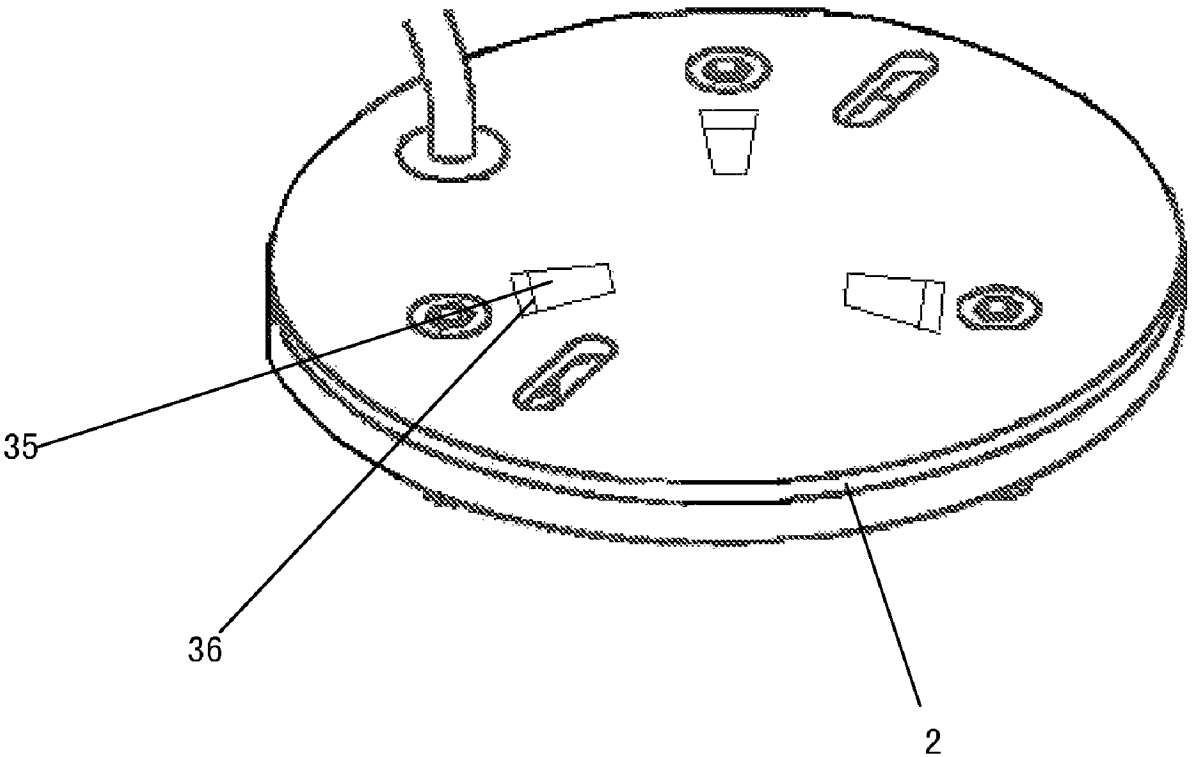
FIG. 7 is a perspective top view of the top plate showing the hook holes with scalloped areas.

Alternatively, as shown in FIG. 7, the hooks may pass through hook holes 35 in the top plate 2 and catch securely on scalloped areas 36 on the exterior surface of the top plate 2 adjacent the hook holes.

At that point, there is a mechanical connection between the top assembly 200, which is connected to the wall, and the bottom assembly 300, which is connected to the device desired to be mounted on the wall as well as an electrical connection between the device and the power supply in the wall. Thus, the device is mechanically connected to the wall, ceiling or other surface and connected with the desired power supply.

With reference to FIGS. 2 and 6C, the cam plate 10, via the moving tab 11A and the fixed tab 11B attached to the cam plate 10, not only holds the hooks 5 in one of three positions, but also engages and disengages the support pins 12 with the key slots 13. The moving tab 11A moves radially towards the center against the tab spring 20 which is stopped or held in place by the tab spring stop 22. The moving tab 11A has on the side opposite the tab spring 20 a locking pin 24, which is a modified dowel pin.

Figure 5:
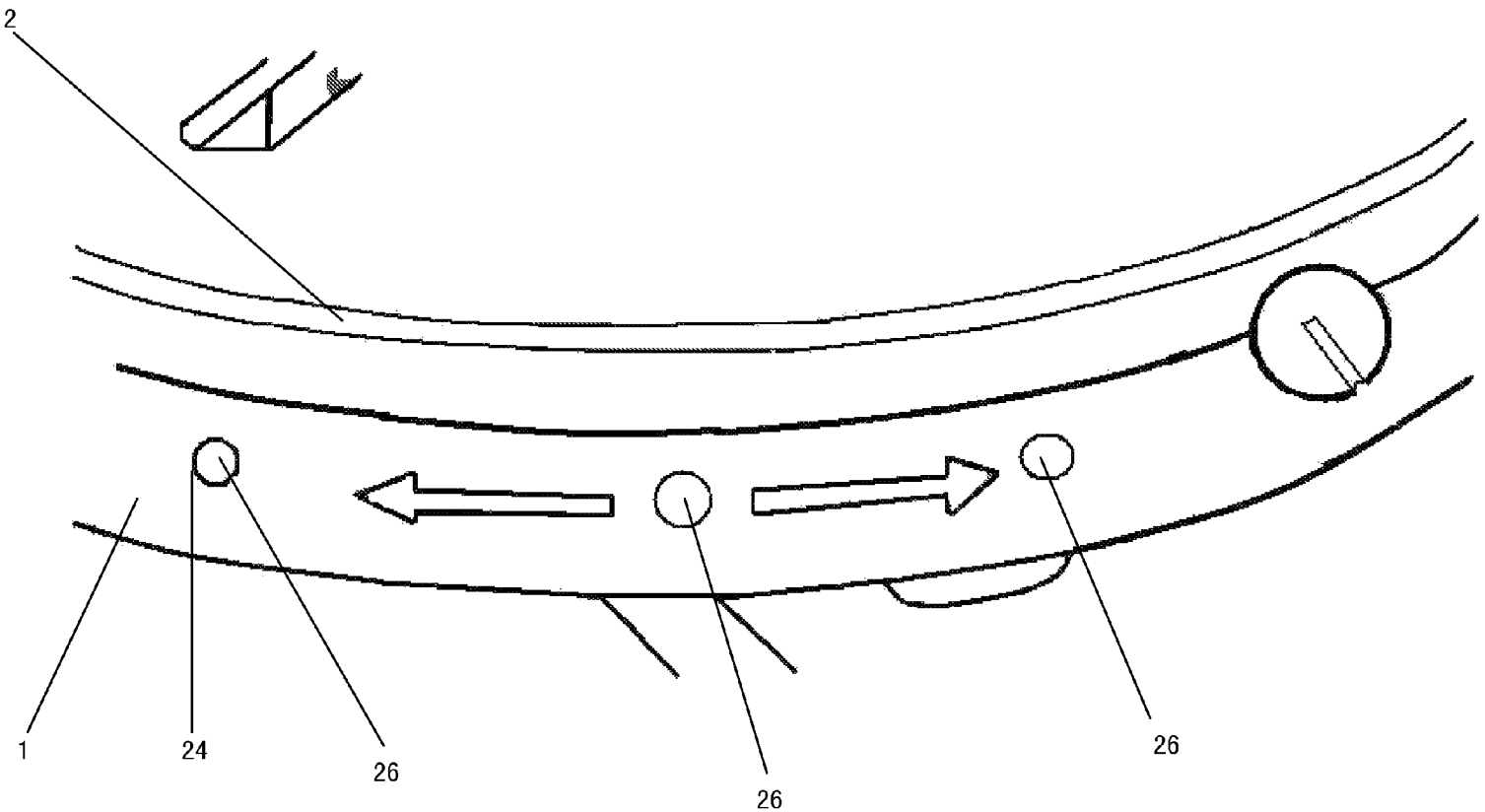
FIG. 5 is a close-up view of locking mechanism of an embodiment of the invention.

With reference to FIG. 5, when the moving tab 11A is not being manually pressed radially toward the center of the assembly, the locking pin 24 is engaged in one of three locking pin holes 26 in the bottom plate 1. When the locking pin 24 is engaged in one of the three locking pin holes 26 the cam plate 10 is prevented from rotating within the bottom assembly 300. When the moving tab 11A is manually pressed radially toward the center of the assembly the locking pin 24 disengages from the locking pin hole 26 and the cam plate 10 can be rotated. Each of the locking pin holes 26 represents one of three states or positions into which the cam plate 10 can be placed. In other words, the moving tab 11A moves radially against the tab spring 20 to release and lock the cam plate 10 into one of three positions.

Alternatively, the tabs may both be fixed tabs and merely provide finger holds for rotating the cam plate into the available positions, without locking the cam in the position.

The first position is "neutral" or "device installation" or "engage", which is the middle position of the three available positions. In the neutral or device installation position, the hooks are positioned in such manner that the beveled edge of the hooks will contact the hook slots when the bottom assembly is brought toward the top assembly, causing the hooks to retract and slide inside the hook slots 9 in the top assembly 200 when the bottom assembly 300 and the top assembly 200 are brought together. In this neutral position, once the hooks 5 are through the hook slots 9, the hook springs 8 operate to pivot the hooks 5 around the rivet 7 so that the hooks 5 engage over the hook slots. Once in this position, the two assemblies 300, 200 are mechanically and electrically connected, thus mechanically connecting the appliance to the support; e.g., the ceiling fan to the ceiling; the TV to the wall. The cam plate 10 via the tabs 11A, 11B is then moved to a "locked" position such that the cam plate 10 and the hooks 5 are locked in place over the hook slots of the top assembly 200 so that the hooks 5 are fully engaged in the top assembly 200 and thus the bottom assembly 300 which is connected to the hooks 5 via the hook mounts 6 cannot be disengaged from the top assembly 200. The cam plate 10 via the tabs 11A, 11B may also be moved to an "open" or "retracted" or "release" position. In the release position, the interior cam profile 15 will force the hooks 5 to retract towards the center of the assembly against the pressure of the hook springs 8 in such position that they will slide out of the hook slots 9, thus disengaging the bottom assembly 300 from the top assembly 200 (and thus, mechanically and electrically disconnecting the ceiling fan, TV, etc., from the wall or ceiling). In addition to controlling the hooks 5, the tabs 11A, 11B also operate the cam plate 10 in such a manner that the support pins 12 on the top assembly 200 engage or disengage as desired with the key slots 13 on the cam plate 10. In the locked position, the cam plate 10 is positioned in such manner to ensure that the support pins 12 are tightly engaged and locked into the key slots 13 and, therefore, the top assembly 200 and bottom assembly 300 remain securely engaged. In the open or retracted position, the cam plate 10 is positioned in such manner to ensure that the support pins 12 are disengaged and free to slide out of the key slots 13 thus enabling the top assembly 200 and the bottom assembly to be slid apart. The support pins 12 are permanently attached to the top assembly 200 via screws and extend downward toward the bottom assembly 300. The cam plate 10 with key slots 13 is located in and attached to the bottom assembly 300, for example, by retaining pins 25. Each of the key slots 13 has a wide end 13A and a narrow end 13B. The key slots 13 are located in the cam plate 10 in such a way that when the tabs 11A, 11B and cam plate 10 are in the open (retracted) or neutral (device installation) positions, the support pins 12 may slide in and out of the key slot 13A. However when the tabs 11A, 11B and the cam plate 10 are in the locked position, the cam plate 10 is rotated in such a manner that the head 12A of the support pins 12 are engaged below the narrow end of the key slot 13B and are unable to slide out of the key slot 13B. In this way, the bottom assembly 300 and the top assembly 200 are bound together by both the hooks 5 and the support pins 12. To disengage the top assembly 200 from the bottom assembly 300, the tabs 11A, 11B and the cam plate 10 are moved to the neutral or open position which places the support pins 12 in an area of the key slots 13A wide enough that the support pins 12 will slip out of the key slot 13A and become disengaged from the key slot.

Thus, the quick mounting device for appliances includes a top assembly attachable to a support and a bottom assembly attachable to an appliance. The top assembly further includes a top plate with mounting slots, support pins, hook slots, and an electrical connector; wherein the mounting slots are positioned to mount the plate to the support, the support pins and the hook slots are securely fastened to the top assembly and project downward.

The bottom assembly includes a bottom plate with mounting bolts; hooks; hook mounts with rivets and springs; a cam plate with key slots having a wide end and a narrow end and an interior profile; cam retaining pins, cam positioning tabs and a mating electrical connector. The mounting bolts secure the plate to the appliance; the hook mounts are securely fastened to the bottom assembly; the hooks are fastened to and pivot around the hook mounts by the rivets; the springs rotate the hooks toward the periphery of the plate; the retaining pins hold the cam in the plate and permit the cam to rotate in the plate; the cam positioning tabs provide finger holds for rotating the cam; the interior cam profile has three positions to permit the hooks to slide past the hook slots for engaging or retract towards the center for removal or expand towards the periphery for locking.

The assemblies are engagable by positioning the cam in the engage position; lifting the bottom assembly toward the top assembly such that the hooks slide past and then engage the hook slots and the support pins extend through the wide end of the cam key slots;

The assemblies are lockable by rotating the cam to the locked position, thereby locking the support pins with the narrow end of the key slots and fully extending the hooks into the hook slots.

The electrical connectors positioned to mate when the top and bottom assemblies are brought together.

Thereby the present invention provides a mounting device that is quickly and easily engaged and disengaged mechanically and electrically without the use of tools and furthermore has two mechanical engagement mechanisms.

The cam tabs may further include a moving cam tab with a locking pin with spring and the lower plate includes three locking pin holes corresponding to an engage position, a lock position, and a release position; the moving tab with locking pin positionable in any of the three locking pin holes and releasably locking the cam in the position.

To use the quick mount device, the user attaches the top assembly 200 to the wall, ceiling or other surface by using screws, bolts or other suitable attachment means through the mounting slots 16 into the wall, ceiling or other surface. If electric power to the device is required, the user may also connect the electrical connector 3 in the top assembly to a power supply. The user then attaches the bottom assembly 300 to the device to be mounted (ceiling fan, etc.) via the special mounting bolts 17. If electrical power is required, the user connects the electrical connector 4 in the bottom assembly to the power leads of the device to be mounted.

The user then moves the cam plate 10 via the tabs 11A, 11B to the neutral position. As the user lifts the device to be mounted toward the top assembly 200 and the hooks 5 begin to engage the hook slots 9 in the top assembly 200, the hooks 5 will pivot around the rivet 7 in such a way to allow the hooks 5 to pass through the hook slots 9. Once the hooks 5 are through the hook slots 9, the hook springs 8 rotate the hooks 5 around the rivets 7 in the opposite direction securing the hooks 5 over the hook slots 9. Thus, merely by lifting the device into place, the device is attached, without the use of tools, to the top assembly 200 and thus the ceiling, wall or other support. Absent the quick mount device, the user would have to lift the device into place and use one arm/hand to hold the device in place while using some sort of tool with the other arm/hand to secure the device to the ceiling or wall. Instead, with the quick mounting device, the hooks 5 hold the device in place thus freeing up both of the user's arm/hands to further secure the device without tools to the ceiling or wall as follows. Once the hooks 5 are engaged over the top assembly 200, the user via the tabs 11A, 11B rotates the cam plate 10 to the locked position. In the locked position, the support pins 12 on the top assembly 200 engage the narrow end of the key slots 13B thus bringing the top assembly 200 and bottom assembly 300 tightly together. The bottom assembly 300 is now completed supported and securely attached to the top assembly 200 by the support pins 12 and not the hooks 5. In fact, in the locked position, the hooks 5 may be raised off of the surface of the top assembly 200. Also, in the locked position the cam profile 15 fully engages the hooks 5 in position over the top assembly 200, giving the device two mechanisms of engaging or holding the assemblies together. Thus, even were the support pins 12 or the key slots 13 to fail, the bottom assembly 300 and the top assembly 200 would remain securely mated and the device would remain mounted on the ceiling or wall because of the hooks.

To remove the device from the ceiling or wall, the tabs 11A, 11B are rotated into the release (retracted; open) position. The support pins 12 are now in the wide end of the key slots 13A where they can be disengaged from the bottom assembly and the hooks 5 are held in a retracted position whereby they can freely pass by the hook slots 9 in the top assembly 12. Thus, the top assembly 200 and the bottom assembly 300 may be disengaged from one another and the device removed from the wall or ceiling.

Certain modifications and improvements will occur to those skilled in the art upon a reading of the foregoing description. The above-mentioned examples are provided to serve the purpose of clarifying the aspects of the invention and it will be apparent to one skilled in the art that they do not serve to limit the scope of the invention. All modifications and improvements have been deleted herein for the sake of conciseness and readability but are properly within the scope of the present invention.

What is claimed is:

1. A quick mounting device for appliances, comprising a top assembly attachable to a support and a bottom assembly attachable to an appliance, a. the top assembly further comprising a top plate with mounting slots, support pins, hook slots, and an electrical connector; wherein the mounting slots are positioned to mount the plate to the support, the support pins and the hook slots are securely fastened to the top assembly and project downward;

b. the bottom assembly comprising a bottom plate with mounting bolts; hooks; hook mounts with rivets and springs; a cam plate with key slots having a wide end and a narrow end, an interior profile; cam retaining pins, cam positioning tabs and a mating electrical connector; wherein the mounting bolts secure the plate to the appliance; the hook mounts are securely fastened to the bottom assembly; the hooks are fastened to and pivot around the hook mounts by the rivets; the springs rotate the hooks toward the periphery of the plate; the retaining pins hold the cam in the plate and permit the cam to rotate in the plate; the cam positioning tabs providing finger holds for rotating the cam; the interior cam profile having three positions to permit the hooks to slide past the hook slots for engaging or retract towards the center for removal or expand towards the periphery for locking;

c. the assemblies engagable by positioning the cam in the engage position; lifting the bottom assembly toward the top assembly such that the hooks slide past and then engage the hook slots and the support pins extend through the wide end of the cam key slots;

d. the assemblies lockable by rotating the cam to the locked position, thereby locking the support pins with the narrow end of the key slots and fully extending the hooks into the hook slots;

e. the electrical connectors positioned to mate when the top and bottom assemblies are brought together;

f. thereby providing a mounting device that is quickly and easily engaged and disengaged mechanically and electrically without the use of tools and furthermore has two mechanical engagement mechanisms.

e. one of the cam tabs is a moving cam tab with a locking pin with spring and the lower plate includes three locking pin holes corresponding to an engage position, a lock position, and a release position; the moving tab with locking pin positionable in any of the three locking pin holes and releasably locking the cam in the position.

* * * * *